US011146899B2

(12) United States Patent
De Vries et al.

(10) Patent No.: US 11,146,899 B2
(45) **Date of Patent: *Oct. 12, 2021**

(54) HEARING DEVICE AND METHOD FOR TUNING HEARING DEVICE PAR

(71) Applicant: GN HEARING A/S, Ballerup (DK)

(72) Inventors: Aalbert De Vries, Eindhoven (NL); Joris Kraak, Eindhoven (NL); Marcus Gerardus Hermanus Cox, Linschoten (NL)

(73) Assignee: GN Hearing A/S, Ballerup (DK)

( * ) Notice: Subject to any disclaimer, the term of this patent is extended or adjusted under 35 U.S.C. 154(b) by 0 days.

This patent is subject to a terminal disclaimer.

(21) Appl. No.: 16/721,901

(22) Filed: Dec. 19, 2019

(65) Prior Publication Data

US 2020/0128343 A1 Apr. 23, 2020

Related U.S. Application Data

(63) Continuation of application No. 16/195,836, filed on Nov. 19, 2018, now Pat. No. 10,735,877.

(30) Foreign Application Priority Data

Nov. 29, 2017 (EP) ..... 17204326

(51) Int. Cl.
*H04R 25/00* (2006.01)

(52) U.S. Cl.
CPC ..... *H04R 25/70* (2013.01); *H04R 25/30* (2013.01); *H04R 25/505* (2013.01); *H04R 25/558* (2013.01); *H04R 2225/43* (2013.01)

(58) Field of Classification Search
CPC .. H04R 25/70; H04R 2225/41; H04R 25/305; H04R 25/30; H04R 29/00
(Continued)

(56) References Cited

U.S. PATENT DOCUMENTS

| | | | |
|---|---|---|---|
| 6,148,274 | A | 11/2000 | Watanabe et al. |
| 2003/0133578 | A1 | 7/2003 | Starkey |
| 2011/0055120 | A1 | 3/2011 | Baskent et al. |

FOREIGN PATENT DOCUMENTS

| | | | |
|---|---|---|---|
| CN | 103222283 | A | 7/2013 |
| EP | 2757813 | A2 | 7/2014 |

(Continued)

OTHER PUBLICATIONS

Extended European Search Report (EESR) dated Jun. 4, 2018 for corresponding EP Application No. 17204326.7.

(Continued)

*Primary Examiner* — George C Monikang
(74) *Attorney, Agent, or Firm* — Vista IP Law Group, LLP

(57) ABSTRACT

A method includes: initializing a model comprising a parameterized objective function based on first and second assumption on the objective function; obtaining an initial test setting; assigning the initial test setting as a primary test setting; obtaining a secondary test setting based on the model; outputting a primary test signal according to the primary test setting; outputting a secondary test signal according to the secondary test setting; obtaining a user input of a preferred test setting indicative of a preference for either the primary test setting or the secondary test setting; updating the model based on the primary test setting, the secondary test setting, and the preferred test setting; and in accordance with a determination that a tuning criterion is satisfied, updating at least one of hearing device parameters of a hearing device based on hearing device parameter(s) of the preferred test setting.

21 Claims, 6 Drawing Sheets

(58) Field of Classification Search
USPC ..... 381/312, 314
See application file for complete search history.

(56) References Cited

FOREIGN PATENT DOCUMENTS

| | | | |
|---|---|---|---|
| EP | 2757813 | A3 | 2/2015 |
| EP | 2986033 | A1 | 2/2016 |
| WO | WO 2004/004414 | A1 | 1/2004 |

OTHER PUBLICATIONS

Van Laar, Thijs and De Vries, Bert, "A Probabilistic Modeling Approach to Hearing Loss Compensation" *transactions on Audio, Speech, and Language processing*, vol. 24, No. 11. Nov. 2016, pp. 14.

Non-Final Office Action dated Oct. 4, 2019 for related U.S. Appl. No. 16/195,836.

Notice of Allowance and Fee(s) dated Mar. 24, 2020 for related U.S. Appl. No. 16/195,836.

Nielsen, Jens Brehm Bagger, Jakob Nielsen, and Jan Larsen. "Perception-based personalization of hearing aids using Gaussian processes and active learning." IEEE/ACM Transactions on Audio, Speech, and Language Processing 23.1 (2014): 162-173.

Heskes, T. M., and B. de Vries. "Incremental utility elicitation for adaptive personalization." (2005).

Foreign Office Action dated Sep. 18, 2020 for EP Appln. No. 17204326.7.

Office Action dated May 7, 2021 for Chinese Patent Application No. 201811424777.5.

Heskes, Tom, et al., "Incremental Utility Elicitation for Adaptive Personalization," Processing of the 17$^{th}$ Belgium-Netherlands Conference on Artificial Intelligence, Oct. 18, 2005, pp. 127-148, IRIS, R&D Group, GN ReSound, Eindhoven, and Signal Processing Systems Group, EE dept., TU Eindhoven, Radboud University, Nijmegen.

Nielsen, Jens Brehm Bagger, et al., "Perception-Based Personalization of Hearing Aids Using Gaussian Processes and Active Learning," IEEE/ACM Transactions on Audio, Speech, and Language Processing, Jan. 31, 2015, pp. 162-172, vol. 23, No. 1.

Van De Laar, Thijs, et al., "A Probabilistic Modeling Approach to Hearing Loss Compensation," IEEE/ACM Transactions on Audio, Speech, and Languace Processing, Nov. 30, 2016, pp. 2200-2213, vol. 24, No. 11.

Translation of Office Action dated May 7, 2021 for Chinese patent application No. 201811424777.5.

(a) $f_1(x) = -\sqrt{100(x-0.25)^2}$ (b) Results of optimization of $f_1$.

(c) $f_2(x) = 5\exp(-25(x-0.25)^2) - 5$ (d) Results of optimization of $f_2$.

HEARING DEVICE AND METHOD FOR TUNING HEARING DEVICE PAR

RELATED APPLICATION DATA

This application is a continuation of U.S. patent application Ser. No. 16/195,836, filed on Nov. 19, 2018, pending, which claims priority to, and the benefit of, European Patent Application No. 17204326.7 filed on Nov. 29, 2017. The entire disclosures of the above applications are expressly incorporated by reference herein.

FIELD

The present disclosure relates to a hearing device and related method, in particular a method for configuring hearing device parameters.

BACKGROUND

Hearing devices with user-selectable programs allowing the user to adjust hearing device programs/hearing device parameters to obtain a satisfactory listening experience are known.

SUMMARY

There is a desire to provide an improved listening experience to a hearing device user. Further, there is a need for a simple and effective way to configure one or more hearing device parameters of a hearing device.

A hearing device is disclosed, the hearing device comprising a set of microphones comprising a first microphone for provision of a first microphone input signal; a processor for processing input signals according to one or more hearing device parameters and providing an electrical output signal based on input signals; a user interface; and a receiver for converting the electrical output signal to an audio output signal. The hearing device, e.g. the processor, is configured to initialize a model comprising a parameterized objective function, e.g. based on a first assumption and/or a second assumption on the objective function; obtain an initial test setting defined by one or more initial test hearing device parameters; assign the initial test setting as a primary test setting; obtain a secondary test setting based on the model, the secondary test setting defined by one or more secondary test hearing device parameters; output a primary test signal according to the primary test setting via the receiver; output a secondary test signal according to the secondary test setting via the receiver; detect a user input of a preferred test setting indicative of a preference for either the primary test setting or the secondary test setting; update the model based on the primary test setting, the secondary test setting, and the preferred test setting; and, optionally in accordance with a determination that a tuning criterion is satisfied, update the hearing device parameters of the hearing device based on hearing device parameters of the preferred test setting.

Further, a method for tuning hearing device parameters of a hearing device is disclosed, the method comprising initializing a model comprising a parameterized objective function, e.g. based on a first assumption and/or a second assumption on the objective function; obtaining an initial test setting defined by one or more initial test hearing device parameters; assigning the initial test setting as a primary test setting; obtaining a secondary test setting based on the model, the secondary test setting defined by one or more secondary test hearing device parameters; outputting a primary test signal according to the primary test setting; outputting a secondary test signal according to the secondary test setting; detecting a user input of a preferred test setting indicative of a preference for either the primary test setting or the secondary test setting; updating the model based on at least one or all of the primary test setting, the secondary test setting, and the preferred test setting; and, optionally in accordance with a determination that a tuning criterion is satisfied, updating the hearing device parameters of the hearing device based on hearing device parameters of the preferred test setting. The method may be performed in a hearing device system comprising the hearing device and/or an accessory device.

It is an advantage of the present disclosure that hearing device parameters can be configured during a normal operating situation and/or with a small number of user inputs/interactions. Thus, a simple and smooth user experience of the hearing device is provided.

A method for tuning hearing device parameters of a hearing device, includes: initializing a model comprising a parameterized objective function based on a first assumption and a second assumption on the objective function; obtaining an initial test setting defined by one or more initial test hearing device parameters; assigning the initial test setting as a primary test setting; obtaining a secondary test setting based on the model, the secondary test setting defined by one or more secondary test hearing device parameters; outputting a primary test signal according to the primary test setting; outputting a secondary test signal according to the secondary test setting; obtaining a user input of a preferred test setting indicative of a preference for either the primary test setting or the secondary test setting; updating the model based on the primary test setting, the secondary test setting, and the preferred test setting; and in accordance with a determination that a tuning criterion is satisfied, updating at least one of the hearing device parameters of the hearing device based on hearing device parameter(s) of the preferred test setting.

Optionally, the method further includes: updating the primary test setting with the preferred test setting; and updating the secondary test setting based on the updated model.

Optionally, the primary test signal is outputted after the primary test setting is updated, and wherein the secondary test signal is outputted after the secondary test setting is updated.

Optionally, the method further includes: outputting an additional primary test signal according to the updated primary test setting; outputting an additional secondary test signal according to the updated secondary test setting; detecting an additional user input of an additional preferred test setting indicative of a preference for either the updated primary test setting or the updated secondary test setting; and updating the model based on the updated primary test setting, the updated secondary test setting, and the additional preferred test setting.

Optionally, the method further includes determining if a continue-optimization criterion is satisfied.

Optionally, the method further includes, in accordance with the continue-optimization criterion being satisfied: updating the primary test setting with the preferred test setting; and updating the secondary test setting based on the updated model.

Optionally, the method further includes repeating the act of updating the primary test setting, and the act of updating the secondary test setting.

Optionally, the primary test signal is outputted after the primary test setting is updated, and wherein the secondary test signal is outputted after the secondary test setting is updated.

Optionally, the method further includes: outputting an additional primary test signal according to the updated primary test setting; outputting an additional secondary test signal according to the updated secondary test setting; and detecting an additional user input of an additional preferred test setting indicative of a preference for either the updated primary test setting or the updated secondary test setting.

Optionally, the first assumption is that the objective function is a smooth function.

Optionally, the second assumption is that the objective function is unimodal.

Optionally, the objective function $f_{\hat{X},\Lambda}(X)$ is given by:

$$f_{\hat{X},\Lambda}(X)=-((X-\hat{X})^T\Lambda(X-\hat{X}))^p,$$

where X is a D-dimensional vector in the hypercube $[0,1]^D$ that represents the hearing device parameters, $\hat{X}$ is a maximizing argument of $f_{\hat{x},\Lambda}$, $\Lambda$ is a positive definite D×D scaling matrix, D is an integer less than 20, and p is a real-valued exponent in a range from 0.01 to 0.99.

Optionally, the objective function $f_{\hat{X},\Lambda}(X)$ is given by:

$$f_{\hat{x},\Lambda}(x)=-\sqrt{(x-\hat{x})T\Lambda(x-\hat{x})}.$$

Optionally, the maximizing argument $\hat{X}$ is constrained by assumptions on the objective function $f_{\hat{X},\Lambda}$, wherein the assumptions are defined by:

$$\hat{X}=\Phi(\hat{Z}),\text{ with }\hat{Z}\sim\mathcal{N}(\mu,\Sigma),$$

where $\Phi(\hat{Z})=\int_{-\infty}^{\hat{Z}}\mathcal{N}(x|0,1)dx$ is a cumulative density function of a normal distribution, and $\hat{Z}$ is a sample from the normal distribution with mean vector $\mu$ and covariance matrix $\Sigma$.

Optionally, the positive definite scaling matrix $\Lambda$ is constrained by assumptions:

$$\Lambda=\text{diagm}([\lambda_1,\ldots,\lambda_D]),\ \lambda_d\sim\text{Gamma}(k_d,\theta_d),$$

where $\lambda_d$ is a sample from a Gamma distribution with shape and scale parameters $k_d$ and $\theta_d$, respectively.

Optionally, the act of obtaining the initial test setting comprises randomly selecting a first initial test hearing device parameter of the one or more initial test hearing device parameters, or selecting one or more current hearing device parameters as the one or more initial test hearing device parameters.

Optionally, the secondary test setting is obtained as a sampling from a posterior distribution $p(\hat{X}|\text{data})$ over a maximizing argument of the objective function, wherein the posterior distribution is conditioned on previously obtained user input.

Optionally, the method further includes prompting a user for the user input.

Optionally, the model is updated based on a Bayesian or approximate Bayesian inference method.

A hearing device includes: a set of microphones comprising a first microphone; a processor coupled to the microphones, the processor configured to process input signals according to one or more hearing device parameters, and to provide an electrical output signal based on the input signals; a user interface; and a receiver configured to provide an audio output signal based on the electrical output signal; wherein the processor is configured to: initialize a model comprising a parameterized objective function based on a first assumption and a second assumption on the objective function; obtain an initial test setting defined by one or more initial test hearing device parameters; assign the initial test setting as a primary test setting; obtain a secondary test setting based on the model, the secondary test setting defined by one or more secondary test hearing device parameters; output a primary test signal according to the primary test setting via the receiver; output a secondary test signal according to the secondary test setting via the receiver; obtain a user input of a preferred test setting indicative of a preference for either the primary test setting or the secondary test setting; update the model based on the primary test setting, the secondary test setting, and the preferred test setting; and in accordance with a determination that a tuning criterion is satisfied, update at least one of the one or more hearing device parameters of the hearing device based on hearing device parameter(s) of the preferred test setting.

BRIEF DESCRIPTION OF THE DRAWINGS

The above and other features and advantages will become readily apparent to those skilled in the art by the following detailed description of exemplary embodiments thereof with reference to the attached drawings, in which.

DETAILED DESCRIPTION

Figure 1:
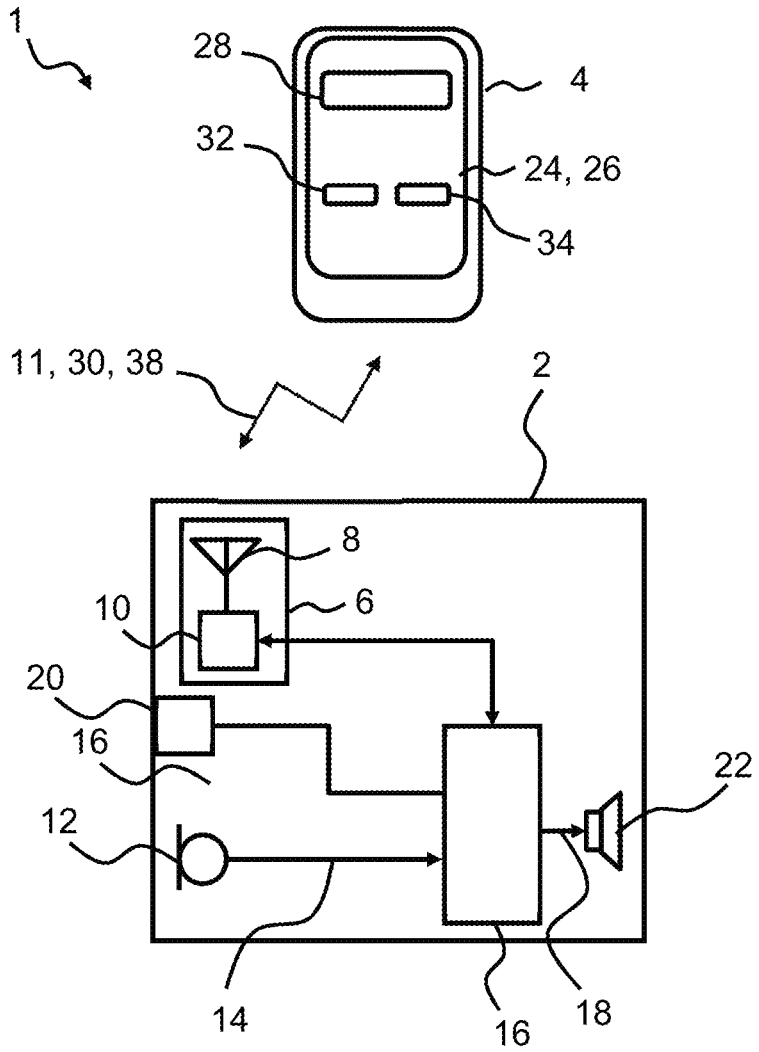
FIG. 1 schematically illustrates an exemplary hearing device and accessory device according to the disclosure.

Various exemplary embodiments and details are described hereinafter, with reference to the figures when relevant. It should be noted that the figures may or may not be drawn to scale and that elements of similar structures or functions are represented by like reference numerals throughout the figures. It should also be noted that the figures are only intended to facilitate the description of the embodiments. They are not intended as an exhaustive description of the invention or as a limitation on the scope of the invention. In addition, an illustrated embodiment needs not have all the aspects or advantages shown. An aspect or an advantage described in conjunction with a particular embodiment is not necessarily limited to that embodiment and can be practiced in any other embodiments even if not so illustrated, or if not so explicitly described.

The present disclosure relates to hearing systems, user accessory device and hearing device thereof, and related methods. The user accessory device forms an accessory device to the hearing device. The user accessory device is typically paired or wirelessly coupled to the hearing device. The hearing device may be a hearing aid, e.g. of the behind-the-ear (BTE) type, in-the-ear (ITE) type, in-the-canal (ITC) type, receiver-in-canal (RIC) type or receiver-in-the-ear (RITE) type. Typically, the hearing device system is in possession of and controlled by the hearing device user. The user accessory device may be a hand-held device, such as smartphone, a smartwatch, a special purpose device, or a tablet computer.

The hearing system may comprise a server device and/or a fitting device. The fitting device is controlled by a dispenser and is configured to determine configuration data, such as fitting parameters. The server device may be controlled by the hearing device manufacturer.

The hearing system is configured to receive and detect a user input of a preferred test setting indicative of a preference for either the primary test setting or the secondary test setting. Accordingly, the hearing system may comprise one or more user interfaces for receiving and/or detecting a user input. For example, the hearing device may comprise a user interface receiving a user input. The user interface of the hearing device may comprise one or more buttons, an accelerometer and/or a voice control unit. The accessory device may comprise a user interface. The user interface of the accessor device may comprise a touch sensitive surface, e.g. a touch display, and/or one or more buttons. The user interface of the accessory device may comprise a voice control unit. The user interface of the hearing device may comprise one or more physical sliders, knobs and/or push buttons. The user interface of the accessory device may comprise one or more physical or virtual (on-screen) sliders, knobs and/or push buttons.

An exemplary method for tuning hearing device parameters of a hearing device comprises initializing a model comprising a parameterized objective function based on a first assumption and a second assumption on the objective function; obtaining an initial test setting defined by one or more initial test hearing device parameters; assigning the initial test setting as a primary test setting; obtaining a secondary test setting based on the model, the secondary test setting defined by one or more secondary test hearing device parameters; outputting a primary test signal according to the primary test setting; outputting a secondary test signal according to the secondary test setting; detecting a user input of a preferred test setting indicative of a preference for either the primary test setting or the secondary test setting; updating the model based on the primary test setting, the secondary test setting, and the preferred test setting; and in accordance with a determination that a tuning criterion is satisfied, updating the hearing device parameters of the hearing device based on hearing device parameters of the preferred test setting.

The method or at least parts thereof may be performed in a hearing device. Parts of the method may be performed in a user accessory device. Performing part(s) of the method in a user accessory device may be advantageous in providing a more smooth user input and user experience. Further, performing part(s) of the method in a user accessory device may be advantageous in providing a more power efficient method from the perspective of the hearing device.

An exemplary method for tuning hearing device parameters of a hearing device comprises initializing a model comprising a parameterized objective function based on a first assumption and a second assumption on the objective function in the accessory device; obtaining an initial test setting defined by one or more initial test hearing device parameters in the accessory device; assigning the initial test setting as a primary test setting in the accessory device; obtaining a secondary test setting based on the model in the accessory device, the secondary test setting defined by one or more secondary test hearing device parameters; outputting a primary test signal according to the primary test setting and a secondary test signal according to the secondary test setting with the hearing device in accordance with a control signal indicative of the primary test setting and the secondary test setting from the accessory device; detecting a user input of a preferred test setting indicative of a preference for either the primary test setting or the secondary test setting in the accessory device; updating the model based on the primary test setting, the secondary test setting, and the preferred test setting in the accessory device; and in accordance with a determination that a tuning criterion is satisfied, updating the hearing device parameters of the hearing device based on hearing device parameters of the preferred test setting, e.g. by transmitting a control signal indicative of the hearing device parameters of the preferred test setting from the accessory device to the hearing device.

In the method, initializing a model may be performed in the hearing device or in a user accessory device.

The first assumption may be that the objective function is a smooth function.

The second assumption may be that the objective function is unimodal.

The objective function may be denoted $f_{\hat{X},\Lambda}(X)$, where X is a D-dimensional vector in the hypercube $[0,1]^D$ that represents the (D) hearing device parameters of the device, $\hat{X}$ is the maximizing argument of $f_{\hat{X},\Lambda}$, and $\Lambda$ is a scaling matrix. The number D of hearing device parameters may be 1 and/or less than 20, such as in the range from 2 to 15.

The objective function $f_{\hat{X},\Lambda}(X)$ may be given by:

$$f_{\hat{X},\Lambda}(X)=-(\alpha(X-\hat{X})^T\Lambda(X-\hat{X}))^p,$$

where X is a D-dimensional vector in the hypercube $[0,1]^D$ that represents the (D) hearing device parameters of the device, $\hat{X}$ is the maximizing argument of $f_{\hat{x},\Lambda}$, $\Lambda$ is a positive definite D×D scaling matrix, wherein D is an integer less than 20, and p is a real-valued exponent in the range from 0.01 to 0.99. The real-valued exponent p may be in the range from 0.2 to 0.8. In an example, the real-valued exponent p may set to 1. $\alpha$ is a real-valued parameter, e.g. equal to or larger than 1.

The objective function $f_{\hat{X},\Lambda}(X)$ may be given by:

$$f_{\hat{x},\Lambda}(x)=-\sqrt{(x-\hat{x})^T\Lambda(x-\hat{X})}.$$

The objective function $f_{\hat{X},\Lambda}(X)$ may be given by:

$$f_{\hat{X},\Lambda}(X)=\exp(-(X-\hat{X})^T\Lambda(X-\hat{X}))$$

The maximizing argument $\hat{X}$ may be constrained by one or more prior assumptions on the objective function $f_{\hat{X},\Lambda}$.

The maximizing argument $\hat{X}$ may be constrained by the following prior assumptions on the objective function $f_{\hat{X},\Lambda}$:

$$\hat{X}=\Phi(\hat{Z}),$$

where $\Phi(\hat{Z})$ is a cumulative density function of a probability distribution, such as the standard normal distribution, and $\hat{Z}$ is a sample from another probability distribution.

In one or more exemplary methods/hearing systems, the maximizing argument $\hat{X}$ may be constrained by the following prior assumptions on the objective function $f_{\hat{X},\Lambda}$:

$$\hat{X}=\Phi(\hat{Z}), \text{ with } \hat{Z}\sim\mathcal{N}(\mu,\Sigma),$$

where $\Phi(\hat{Z})=\int_{-\infty}^{\hat{Z}}\mathcal{N}(x|0,1)dx$ is the cumulative density function of the standard normal distribution, and $\hat{Z}$ is a sample from the normal distribution with mean vector $\mu$ and covariance matrix $\Sigma$. Values of the mean and covariances are learned from the user responses.

The scaling matrix $\Lambda$ may be a positive-definite scaling matrix $\Lambda$, for example constrained by the following prior assumptions:

$$\Lambda=\text{diagm}([\lambda_1,\ldots,\lambda_D]),\ \lambda d\sim\text{Gamma}(k_d,\theta_d),$$

where $\lambda_d$ is a sample from the Gamma distribution with shape and scale parameters $k_d$ and $\theta_d$ respectively. Values for the shape and scale parameters are learned from the user responses.

The scaling matrix Λ has two functions. Firstly, the diagonal elements of A are scaling factors for the individual hearing device parameters, and secondly the off-diagonal values allow to model correlations between the hearing device parameters. In one or more exemplary methods/hearing devices, the correlations between the hearing device parameters are not modelled in the prior assumption (Λ is diagonal).

The scaling matrix A does not need to be a diagonal matrix. The scaling matrix A may be selected as $\Lambda=L'*L$, where L is a low-triangular matrix (also known as the Cholesky decomposition of Λ). Gaussian priors may be applied on each of the elements of L, e.g., $L_{ij}\sim\mathcal{N}(\mu_{ij},\sigma_{ij}^2)$.

In one or more exemplary methods/hearing systems, the maximizing argument $\hat{X}$ may be constrained by the prior assumption:

$$p(\hat{X})=\Pi_{d=1}^{D}\mathrm{Beta}(\hat{X}|a_d,b_d),$$

where Beta( ) is the Beta distribution with shape parameters a and b. Values for the shape parameters are learned from the user responses.

The method may comprise updating the primary test setting with the preferred test setting; updating the secondary test setting, e.g. based on the updated model, the secondary test setting defined by one or more secondary test hearing device parameters; outputting the primary test signal according to the primary test setting; outputting the secondary test signal according to the secondary test setting; detecting a user input of a preferred test setting indicative of a preference for either the primary test setting or the secondary test setting; and optionally updating the model based on the primary test setting, the secondary test setting, and the preferred test setting or based on at least one of the primary test setting, the secondary test setting, and the preferred test setting.

The method may comprise determining if a continue-optimization criterion is satisfied and optionally forgo outputting test signals and detecting user input of preferred test setting in accordance with the continue-optimization criterion not being satisfied (in other words in accordance with a stop criterion being satisfied). The continue-optimization criterion may be based on the primary test setting and the secondary test setting. An exemplary continue-optimization criterion may be satisfied or at least partly satisfied if the model updates seem to converge to fixed parameter settings. The continue-optimization criterion may be based on a count of the number of user inputs. An exemplary continue-optimization criterion may be satisfied or at least partly satisfies if the number of user inputs in a given optimization sequence is less than ten, such as in the range from two to eight.

The method may comprise in accordance with the continue-optimization criterion being satisfied, repeating: updating the primary test setting with the preferred test setting; updating the secondary test setting based on the updated model, the secondary test setting defined by one or more secondary test hearing device parameters; outputting the primary test signal according to the primary test setting; outputting the secondary test signal according to the secondary test setting; and detecting a user input of a preferred test setting indicative of a preference for either the primary test setting or the secondary test setting.

Obtaining an initial test setting may comprise randomly selecting a first initial test hearing device parameter of the one or more initial test hearing device parameters and/or selecting one or more current hearing device parameters as the one or more initial test hearing device parameters.

Obtaining a secondary test setting based on the model may comprise obtaining the secondary test setting as a sampling from a posterior distribution also denoted $p(\hat{X}|\text{data})$ over the maximizing argument of the objective function, e.g. by Thompson sampling. The posterior distribution may be conditioned on one or more, such as all, previously obtained user input. The present method and hearing device allows for explicitly describing a probability distribution over the maximizing argument, i.e. $p(\hat{X}|\text{data})$, where data denotes the data that follows or is obtained from all interaction with the user.

Detecting a user input of a preferred test setting indicative of a preference for either the primary test setting or the secondary test setting may comprise prompting the user for the user input. Detecting a user input may be performed on the hearing device, e.g. by a user activating a button and/or an accelerometer (e.g. single or double tapping the hearing device housing) in the hearing device. Detecting a user input may be performed on the accessory device, e.g. by a user selecting a user interface element representative of the preferred test setting. Detecting a user input may be performed on the accessory device, e.g. by a user selecting a user interface element representative of the preferred test setting on a touch-sensitive display.

Updating the model may be based on a Bayesian inference method. Updating the model may comprise updating one or more of the parameters of the model. In one or more exemplary methods/hearing devices/accessory devices, updating the model may comprise updating one or more, e.g. all, of the mean vector μ, the covariance matrix Σ, and the shape and scale parameters $k_d$ and $\theta_d$. Updating the model, or parameters thereof may be based on variational optimization, Laplace approximation or Monte Carlo sampling.

Updating the hearing device parameters of the hearing device is based on hearing device parameters of the preferred test setting. For example, the hearing device parameters of the hearing device may be set to the maximizing argument $\hat{X}$ of the objective function. In one or more exemplary methods/hearing devices, the hearing device parameters of the hearing device may be updated after each test cycle, i.e. after each user input, however, in order to not confuse the user and/or save power, the hearing device parameters of the hearing device may be updated in accordance with a tuning criterion being satisfied. In one or more exemplary methods/hearing devices, the tuning criterion is satisfied when the continue-optimization criterion is not satisfied, i.e. when tuning of the hearing device parameters is done.

The hearing device comprises: a set of microphones comprising a first microphone for provision of a first microphone input signal; a processor for processing input signals including the first microphone input signal or pre-processed first microphone input signal according to one or more hearing device parameters and providing an electrical output signal based on input signals; a user interface; and a receiver for converting the electrical output signal to an audio output signal. The processor is optionally configured to compensate for hearing loss of the user.

The processor is configured to initialize a model comprising a parameterized objective function based on a first assumption and a second assumption on the objective function; obtain an initial test setting defined by one or more initial test hearing device parameters; assign the initial test setting as a primary test setting; obtain a secondary test setting based on the model, the secondary test setting defined by one or more secondary test hearing device parameters; output a primary test signal according to the primary test setting via the receiver; output a secondary test signal according to the secondary test setting via the receiver; detect a user input of a preferred test setting indicative of a preference for either the primary test setting or the secondary test setting; update the model based on the primary test setting, the secondary test setting, and the preferred test setting; and in accordance with a determination that a tuning criterion is satisfied, update the hearing device parameters of the hearing device based on hearing device parameters of the preferred test setting.

FIG. 1 shows an exemplary hearing system. The hearing system 1 comprises a hearing device 2 and an accessory device 4. The hearing device 2 optionally comprises a transceiver module 6 for (wireless) communication with the accessory device 4 and optionally a contralateral hearing device (not shown in FIG. 1). The transceiver module 6 comprises antenna 8 and transceiver 10, and is configured for receipt and/or transmission of wireless signals via wireless connection 11 to the accessory device 4. The hearing device 2 comprises a set of microphones comprising a first microphone 12 for provision of a first microphone input signal 14; a processor 16 for processing input signals including the first microphone input signal 14 according to one or more hearing device parameters and providing an electrical output signal 18 based on input signals; a user interface 20 connected to the processor 16; and a receiver 22 for converting the electrical output signal 18 to an audio output signal.

The accessory device 4 is a smartphone and comprises a user interface 24 comprising a touch display 26, and a processor (not shown). The accessory device 4 is in a setting adjustment mode for adjusting a setting, i.e. one or more hearing device parameters, of the hearing device 2.

The hearing device 2 (processor 16) or the accessory device 4 is configured to initialize a model comprising a parameterized objective function based on a first assumption and a second assumption on the objective function, e.g. in accordance a determination that a start criterion is satisfied. The start criterion may be satisfied if a user input on user interface 20 or user interface 24 indicative of a user desire to start optimization has been detected, e.g. by activation of virtual start button 28 on the accessory device 4.

The hearing device 2 or the accessory device 4 is configured to obtain an initial test setting defined by one or more initial test hearing device parameters; assign the initial test setting as a primary test setting; and obtain a secondary test setting based on the model, the secondary test setting defined by one or more secondary test hearing device parameters.

In an implementation including accessory device 4, the accessory device 4 may be configured to send a control signal 30 to the hearing device 2, the control signal 30 being indicative of the primary test setting and the secondary test setting, thus enabling the hearing device 2 to output test signals accordingly.

The hearing device 2 (processor 16) is configured to output a primary test signal according to the primary test setting via the receiver 22 and a secondary test signal according to the secondary test setting via the receiver 22.

The hearing device 2 (processor 16) or the accessory device 4 is configured to detect a user input of a preferred test setting indicative of a preference for either the primary test setting or the secondary test setting, e.g. by detecting a user input on user interface 20 or by detecting a user selection of one of a primary virtual button 32 and a secondary virtual button 34 on the user interface 26 of accessory device 4.

The hearing device 2 (processor 16) and/or the accessory device 4 is configured to update the model based on the primary test setting, the secondary test setting, and the preferred test setting; and in accordance with a determination that a tuning criterion is satisfied, update the hearing device parameters of the hearing device based on hearing device parameters of the preferred test setting. The tuning criterion may be satisfied when a user provides a user input indicative of a desire to stop optimization, e.g. by detecting a user selection of a stop virtual button (not shown) on the user interface 26 of accessory device 4 and/or when a pre-set number of user inputs of preferred test setting(s).

In an implementation including accessory device 4, the accessory device 4 may be configured to send a control signal 32 to the hearing device 2, the control signal 38 being indicative of the hearing device parameters of the preferred test setting, thus enabling the hearing device to update the hearing device parameters of the hearing device.

Figure 2:
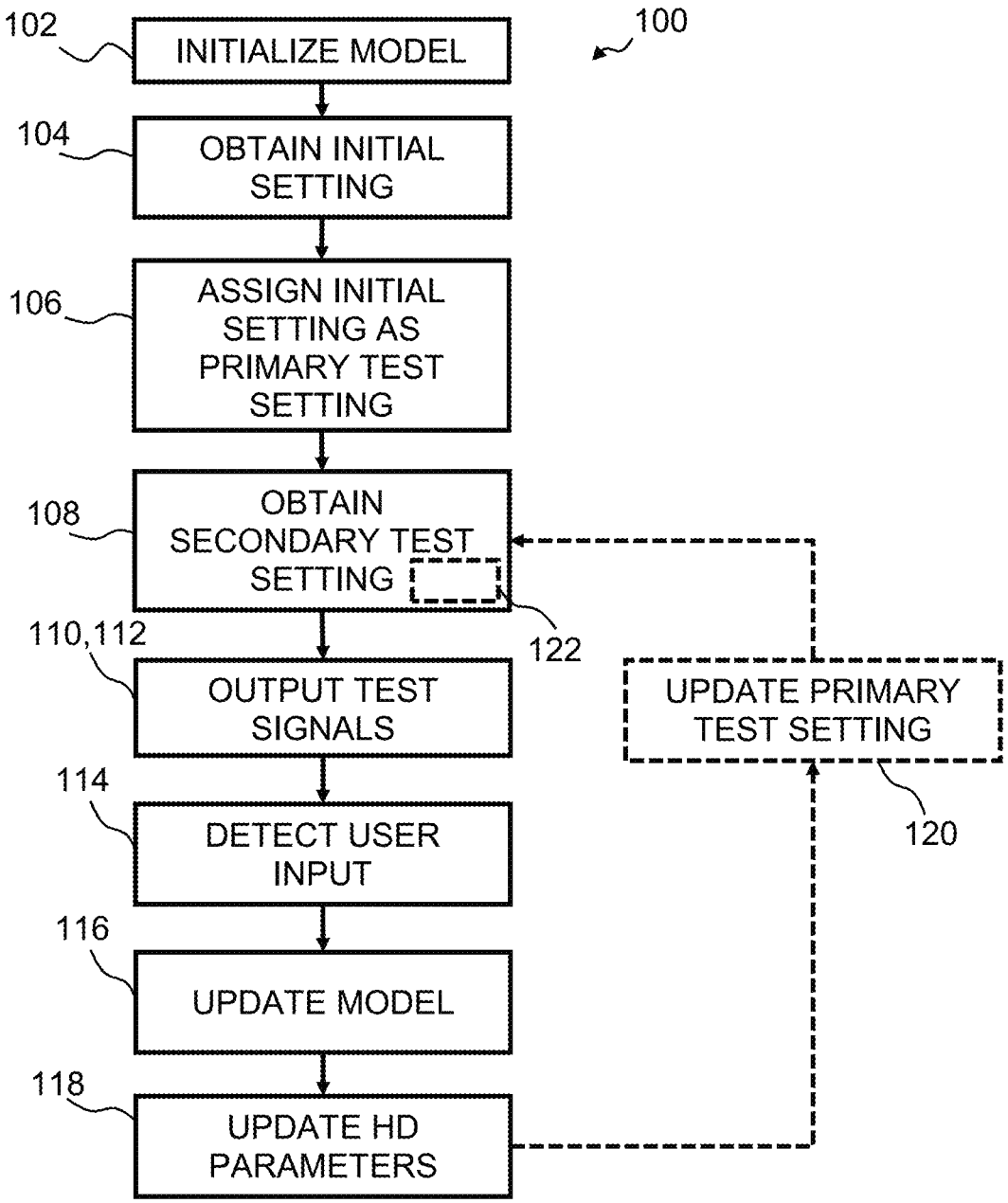
FIG. 2 is a flow diagram of an exemplary method according to the disclosure.

FIG. 2 is a flow diagram of an exemplary method for tuning hearing device parameters of a hearing device. The method 100 comprises initializing 102 a model comprising a parameterized objective function based on a first assumption and a second assumption on the objective function. The objective function $f_{2,\Lambda}(X)$ is given by:

$$f_{\hat{X},\Lambda}(X)=-((X-\hat{X})^T\Lambda(X-\hat{X}))^p,$$

where X is a D-dimensional vector in the hypercube $[0,1]^D$ that represents the (D) hearing device parameters of the device, $\hat{X}$ is the maximizing argument of $f_{\hat{X},\Lambda}$, $\Lambda$ is a positive definite D×D scaling matrix, wherein D is an integer less than 20, and p is 0.5. The maximizing argument $\hat{X}$ is constrained by the following prior assumptions on the objective function $f_{\hat{X},\Lambda}$:

$$\hat{X}=\Phi(\hat{Z}),\ \text{with}\ \hat{Z}\sim\mathcal{N}(\mu,\Sigma),$$

where $\Phi(\hat{z})=\int_{-\infty}^{\hat{z}}\mathcal{N}(x|0,1)dx$ is the cumulative density function of the standard normal distribution, and $\hat{Z}$ is a sample from the normal distribution with mean vector $\mu$ and covariance matrix $\Sigma$. The positive-definite scaling matrix A is constrained by the following prior assumptions:

$$\Lambda=\text{diagm}([\lambda_1,\ldots,\lambda_D]),\ \lambda_d\sim\text{Gamma}(k_d,\theta_d),$$

where $\lambda_d$ is a sample from the Gamma distribution with shape and scale parameters $k_d$ and $\theta_d$, respectively.

The method 100 comprises obtaining 104 an initial test setting defined by one or more initial test hearing device parameters and assigning 106 the initial test setting as a primary test setting. The method 100 comprises obtaining 108 a secondary test setting based on the model by sampling from a posterior distribution also denoted $p(\hat{X}|\text{data})$ over the maximizing argument of the objective function, the secondary test setting defined by one or more secondary test hearing device parameters.

The method 100 proceeds to outputting, with the hearing device, 110 a primary test signal according to the primary test setting and outputting, with the hearing device, a secondary test signal 112 according to the secondary test setting.

The method 100 comprises detecting 114 a user input of a preferred test setting indicative of a preference for either the primary test setting or the secondary test setting; and updating 116 the model based on the primary test setting, the secondary test setting, and the preferred test setting, wherein updating the model comprises updating the mean vector $\mu$, the covariance matrix $\Sigma$, and the shape and scale parameters $k_d$ and $\theta_d$ based on variational optimization.

The method 100 comprises updating 118 the hearing device parameters of the hearing device based on hearing device parameters of the preferred test setting.

Updating 118 the hearing device parameters and updating 120 the primary test setting may be integrated in a single operation, e.g. updating 120 the primary test setting may be performed as an integrated part of updating 118 the hearing device parameters.

Updating 116 the model and updating 120 the primary test setting may be integrated in a single operation, e.g. updating 120 the primary test setting may be performed as an integrated part of updating 116 the model.

The method 100 may be a continuous method and may comprise updating 120 the primary test setting with the preferred test setting; and optionally, as part of obtaining 108 the secondary test setting, updating 122 the secondary test setting based on the updated model.

Figure 3:
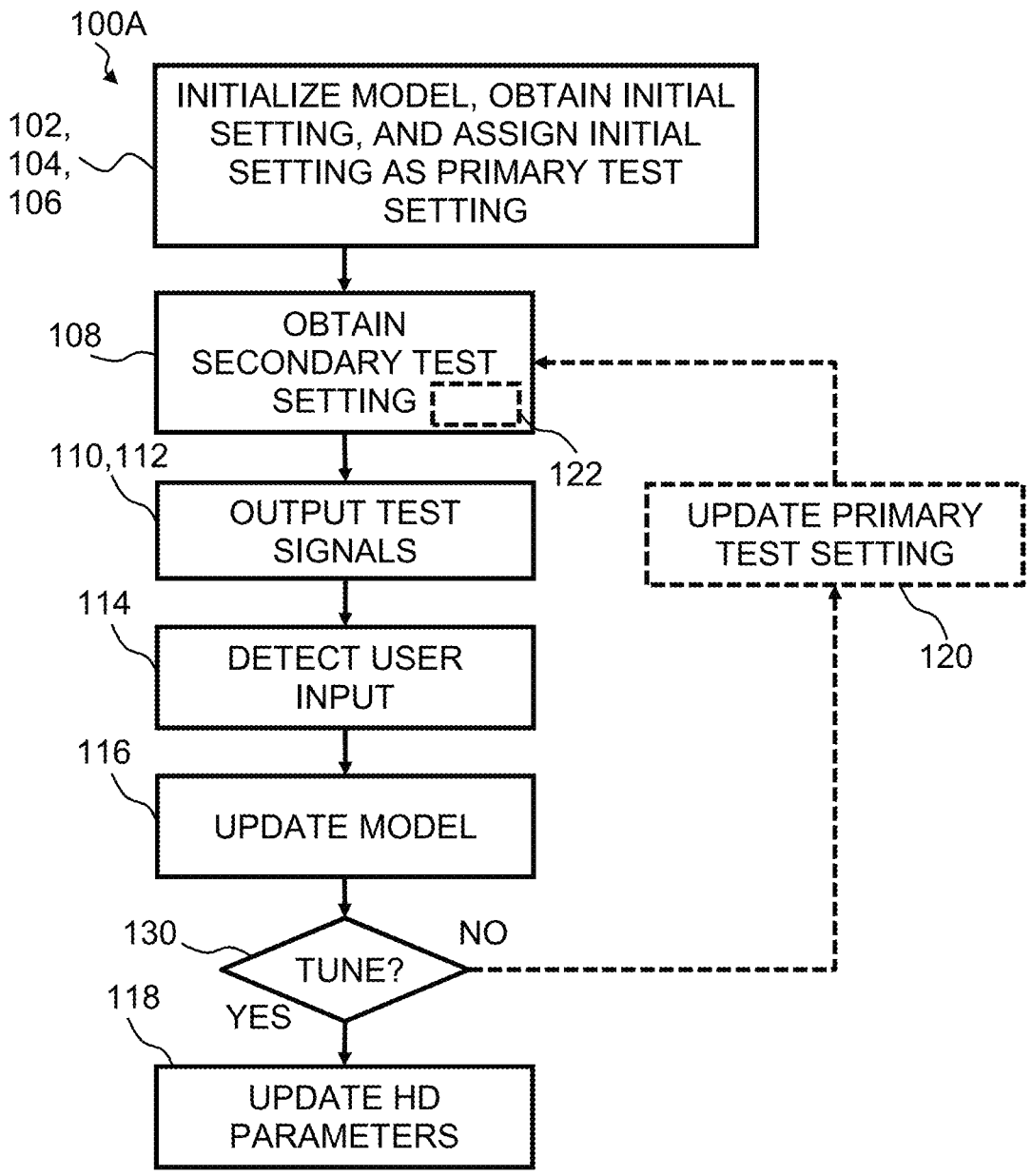
FIG. 3 is a flow diagram of an exemplary method according to the disclosure.

FIG. 3 is a flow diagram of an exemplary method for tuning hearing device parameters of a hearing device. The method 100A implements a conditioned updating of hearing device parameters of the hearing device. This may be advantageous, e.g. if acts 102, 104, 106, 108, 114, 116 of the method are implemented at least partly in an accessory device, since receipt/transmission in/from the hearing device required in connection with update 118 can be reduced. The method 100A comprises determining if a tuning criterion is satisfied and in accordance with a determination that the tuning criterion is satisfied 130, updating 118 the hearing device parameters of the hearing device based on hearing device parameters of the preferred test setting. Further, normal operation of the hearing device is not affected until a preferred setting is obtained. The method 100A may comprise, in accordance with a determination that the tuning criterion is not satisfied 130, updating 120 the primary test setting with the preferred test setting; and updating 122, as part of obtaining 108 secondary test setting, the secondary test setting based on the updated model.

Figure 4:
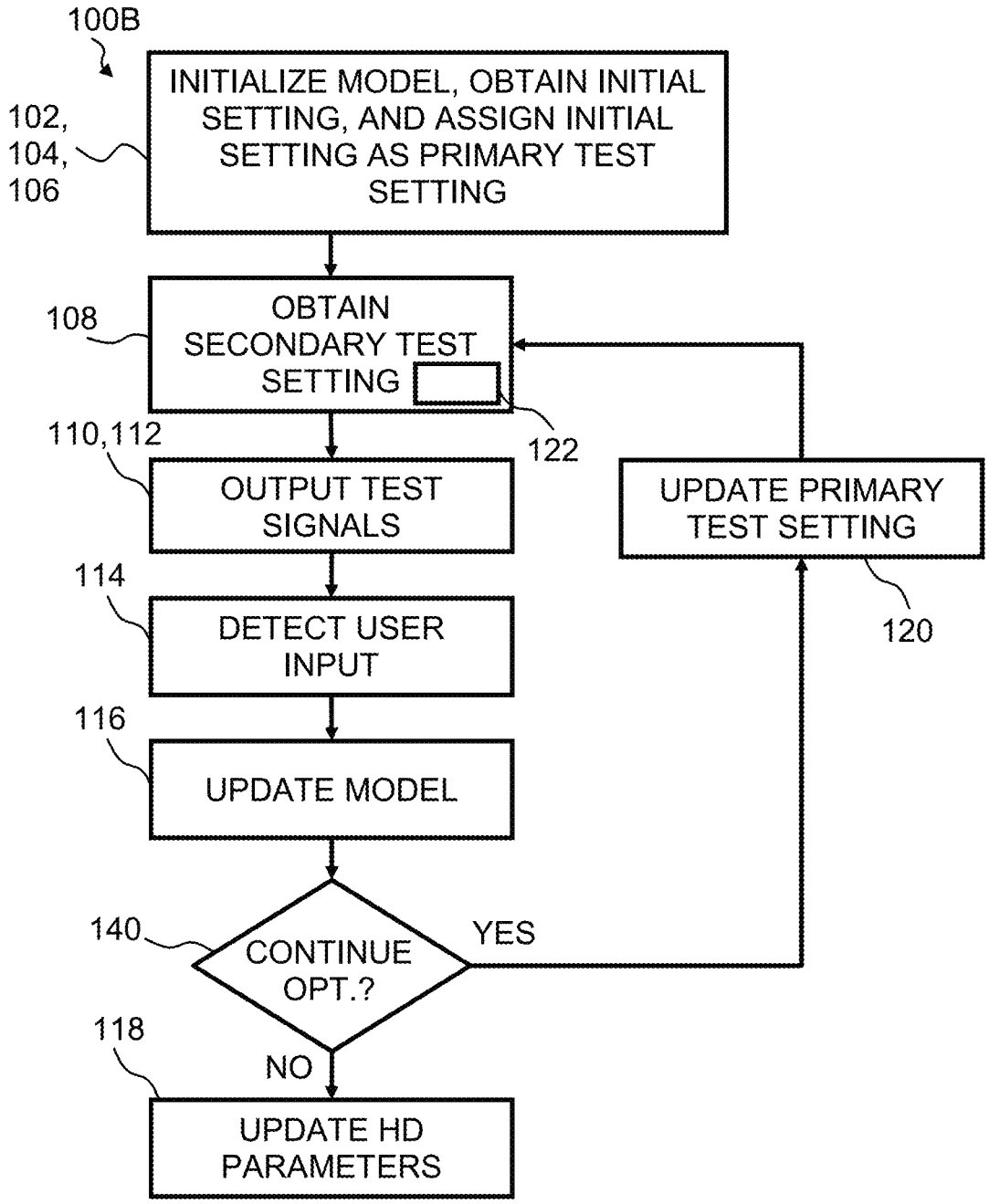
FIG. 4 is a flow diagram of an exemplary method according to the disclosure.

FIG. 4 is a flow diagram of an exemplary method for tuning hearing device parameters of a hearing device. The method 100B comprises determining if a continue-optimization criterion is satisfied and in accordance with the continue-optimization criterion being satisfied 140, repeating updating 120 the primary test setting with the preferred test setting; updating 122 the secondary test setting based on the updated model, the secondary test setting defined by one or more secondary test hearing device parameters; outputting 110 the primary test signal according to the primary test setting; outputting 112 the secondary test signal according to the secondary test setting; and detecting 114 a user input of a preferred test setting indicative of a preference for either the primary test setting or the secondary test setting. When the continue-optimization criterion is satisfied, the method 100B proceeds to updating 118 hearing device parameters of the hearing device.

Figure 5:
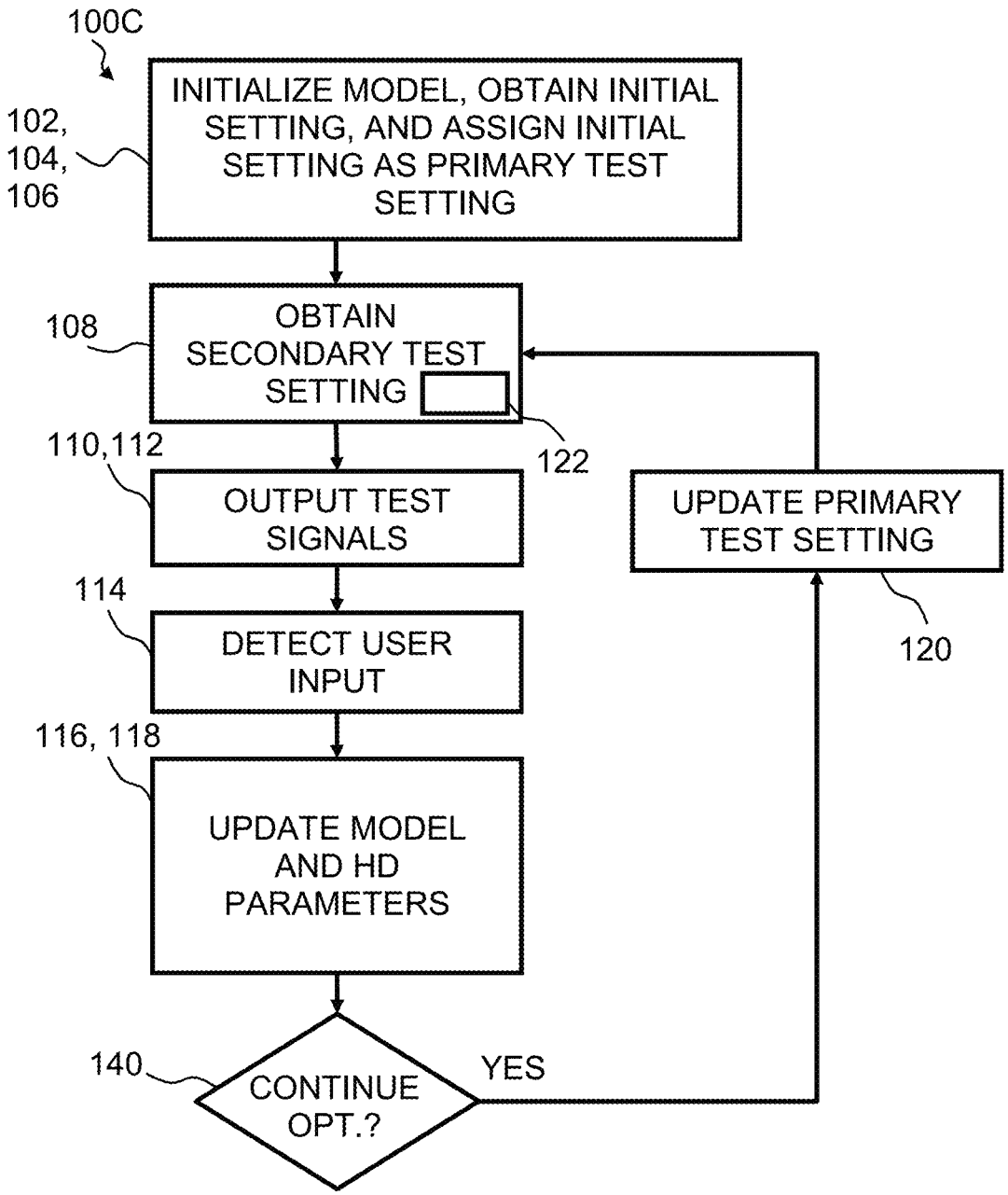
FIG. 5 is a flow diagram of an exemplary method according to the disclosure.

FIG. 5 is a flow diagram of an exemplary method for tuning hearing device parameters of a hearing device. In the method 100C, the hearing device parameters are updated 118 in each optimization cycle.

Figure 6:
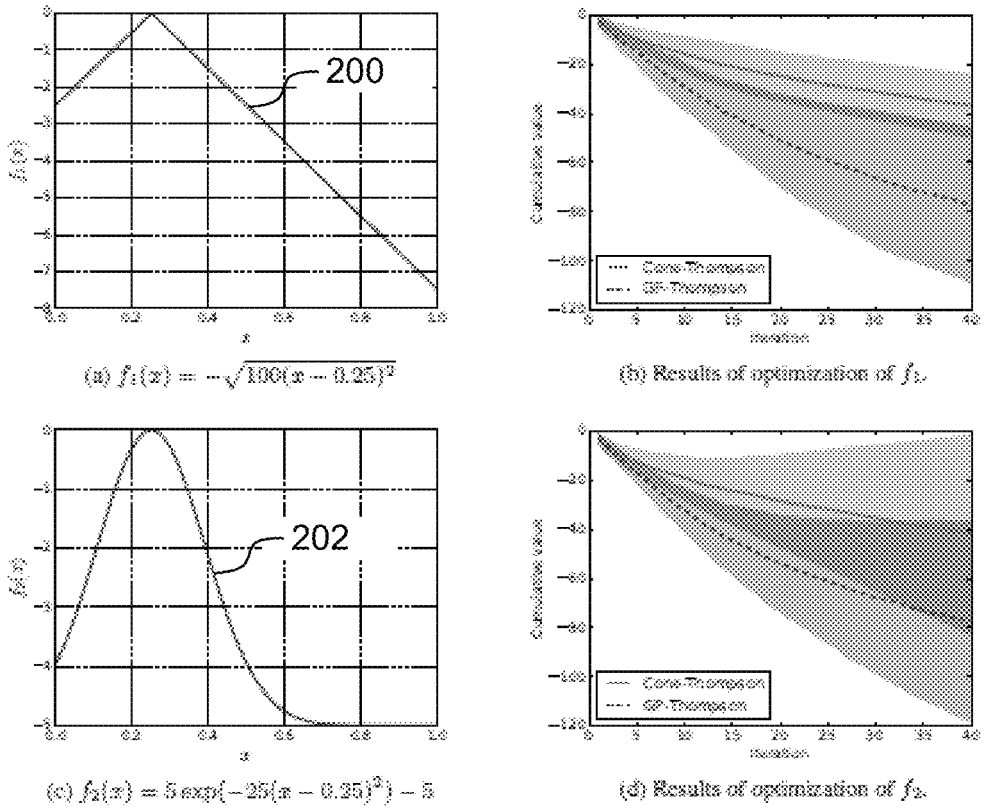
FIG. 6 illustrates results of optimization of different objective functions.

FIG. 6 illustrates results of optimization of a hearing device parameter with different objective functions. The first objective function $f_1$ is a 1-dimensional cone depicted in FIG. 6*a*. The second objective function $f_2$ is bell-shaped, shown in FIG. 6*c*. The cone variant of the parametric model (Cone-Thompson) is compared to a GP model with a squared exponential kernel (GP-Thompson).

Since the parametric model assumes the objective function to have the analytical form of a cone, there is a model mismatch in the second experiment, allowing us to test the robustness under mismatch. Priors $p(\hat{X})$ and $p(\Lambda)$ are chosen to be uninformative. User inputs $x'_1, \ldots, x'_{40}$ are selected through Thompson sampling under both models. The hyper-parameters of the GP model are fitted in every iteration by marginal log-likelihood optimization. The results in FIGS. 6*b* and 6*d* show that the present method consistently and significantly outperforms GP-Thompson on both objective functions. FIGS. 6*b* and 6*d* depict the so-called "cumulative value" curves, which are the cumulative sums of the objective function values at the inputs $x'_1, \ldots, x'_{40}$. Larger cumulative values correspond to inputs $x'_1, \ldots, x'_{40}$ that are closer to the optimal parameter value. The fact that the Cone-Thompson curves are consistently above the GP-Thompson curves indicates that the Cone-Thompson algorithm select better inputs than the GP-Thompson algorithm.

The use of the terms "first", "second", "third" and "fourth", "primary", "secondary", "tertiary" etc. does not imply any particular order, but are included to identify individual elements. Moreover, the use of the terms "first", "second", "third" and "fourth", "primary", "secondary", "tertiary" etc. does not denote any order or importance, but rather the terms "first", "second", "third" and "fourth", "primary", "secondary", "tertiary" etc. are used to distinguish one element from another. Note that the words "first", "second", "third" and "fourth", "primary", "secondary", "tertiary" etc. are used here and elsewhere for labelling purposes only and are not intended to denote any specific spatial or temporal ordering. Furthermore, the labelling of a first element does not imply the presence of a second element and vice versa.

Although particular features have been shown and described, it will be understood that they are not intended to limit the claimed invention, and it will be made obvious to those skilled in the art that various changes and modifications may be made without departing from the spirit and scope of the claimed invention. The specification and drawings are, accordingly to be regarded in an illustrative rather than restrictive sense. The claimed invention is intended to cover all alternatives, modifications, and equivalents.

LIST OF REFERENCES

1 hearing system
2 hearing device
3 accessory device
6 transceiver module
8 antenna
10 transceiver
11 wireless connection 11 between hearing device and accessory device
12 first microphone
14 first microphone input signal
16 processor
18 electrical output signal
20 user interface
22 receiver
24 user interface of accessory device
26 touch display
28 start button 28
30 control signal indicative of primary and secondary test setting
32 primary virtual button
34 secondary virtual button
38 control signal indicative of the hearing device parameters of the preferred test setting

100, 100A, 100B, 100C method for tuning hearing device parameters
102 initializing a model
104 obtaining an initial test setting
106 assigning the initial test setting as a primary test setting
108 obtaining a secondary test setting
110 outputting a primary test signal according to the primary test setting
112 outputting a secondary test signal according to the secondary test setting
114 detecting a user input of a preferred test setting
116 updating the model
118 updating the hearing device parameters of the hearing device
120 updating the primary test setting
122 updating the secondary test setting
130 in accordance with a determination that the tuning criterion satisfied
140 in accordance with a continue-optimization criterion being satisfied
200 first objective function
202 second objective function

The invention claimed is:

1. A method for tuning a hearing device comprising:
obtaining a model comprising a parameterized objective function;
obtaining a first test setting comprising one or more first test hearing device parameters;
obtaining a second test setting based on the model, the second test setting comprising one or more second test hearing device parameters;
outputting a first test signal according to the first test setting;
outputting a second test signal according to the second test setting;
obtaining a user input indicative of a preference for the first test setting or the second test setting as a preferred test setting;
updating the model based on the preferred test setting; and
updating the hearing device based on information associated with the preferred test setting.

2. The method according to claim 1, further comprising:
updating the first test setting with the preferred test setting; and
updating the second test setting based on the updated model.

3. The method according to claim 2, wherein the first test signal is outputted after the first test setting is updated, and wherein the second test signal is outputted after the second test setting is updated.

4. The method according to claim 2, further comprising:
outputting an additional first test signal according to the updated first test setting;
outputting an additional second test signal according to the updated second test setting;
detecting an additional user input indicative of a preference for the updated first test setting or the updated second test setting as an additional preferred test setting; and
updating the model based on the additional preferred test setting.

5. The method according to claim 1, further comprising determining if a continue-optimization criterion is satisfied.

6. The method according to claim 5, further comprising, in accordance with the continue-optimization criterion being satisfied:
updating the first test setting with the preferred test setting; and
updating the second test setting based on the updated model.

7. The method according to claim 6, further comprising repeating the act of updating the first test setting, and the act of updating the second test setting.

8. The method according to claim 6, wherein the first test signal is outputted after the first test setting is updated, and wherein the second test signal is outputted after the second test setting is updated.

9. The method according to claim 6, further comprising:
outputting an additional first test signal according to the updated first test setting;
outputting an additional second test signal according to the updated second test setting; and
detecting an additional user input indicative of a preference for the updated first test setting or the updated second test setting.

10. The method according to claim 1, wherein in the model, the objective function is assumed to be a smooth function.

11. The method according to claim 1, wherein in the model, the objective function is assumed to be unimodal.

12. The method according to claim 1, wherein the act of obtaining the initial test setting comprises randomly selecting a first initial test hearing device parameter of the one or more initial test hearing device parameters, or selecting one or more current hearing device parameters as the one or more initial test hearing device parameters.

13. The method according to claim 1, wherein the second test setting is obtained as a sampling from a posterior distribution $p(\hat{X}|\text{data})$ over a maximizing argument of the objective function, wherein the posterior distribution is conditioned on previously obtained user input.

14. The method according to claim 1, further comprising prompting a user for the user input.

15. The method of claim 1, wherein the information associated with the preferred test setting comprises at least one of the one or more first test hearing device parameters of the first test setting, or at least one of the one or more second test hearing device parameters of the second test setting.

16. A method for tuning a hearing device, comprising:
obtaining a model comprising a parameterized objective function;
obtaining a first test setting comprising one or more first test hearing device parameters;
obtaining a second test setting based on the model, the second test setting comprising one or more second test hearing device parameters;
outputting a first test signal according to the first test setting;
outputting a second test signal according to the second test setting;
obtaining a user input indicative of a preference for the first test setting or the second test setting as a preferred test setting;
updating the model based on the preferred test setting; and
updating the hearing device based on information associated with the preferred test setting;
wherein the objective function $f_{\hat{X},\Lambda}(X)$ is given by:

$$f_{\hat{X},\Lambda}(X)=-((X-\hat{X})^T\Lambda(X-\hat{X}))^p,$$

where X is a D-dimensional vector, $\hat{X}$ is an argument of $f_{\hat{x},\Lambda}$, $\Lambda$ is a D×D matrix, D is an integer, and p is a real-valued exponent.

17. The method according to claim 16, wherein the objective function $f_{\hat{X},\Lambda}(X)$ is given by:

$$f_{\hat{x},\Lambda}(x)=-\sqrt{(x-\hat{x})T\Lambda(x-\hat{x})}.$$

18. The method according to claim 16, wherein the argument $\hat{X}$ is constrained by assumptions on the objective function $f_{\hat{X},\Lambda}$, wherein the assumptions are defined by:

$$\hat{X}=\Phi(\hat{Z}),\text{ with }\hat{Z}\sim\mathcal{N}(\mu,\Sigma),$$

where $\Phi(\hat{Z})=\int_{-\infty}^{\hat{Z}}\mathcal{N}(x|0,1)dx$ is a cumulative density function of a normal distribution, and $\hat{Z}$ is a sample from the normal distribution with mean vector $\mu$ and covariance matrix $\Sigma$.

19. The method according to claim 16, wherein the matrix $\Lambda$ is constrained by assumptions:

$$\Lambda=\text{diagm}([\lambda_1,\ldots,\lambda_D]),\ \lambda_d\sim\text{Gamma}(k_d,\theta_d),$$

where $\lambda_d$ is a sample from a Gamma distribution with shape and scale parameters $k_d$ and $\theta_d$, respectively.

20. A method for tuning a hearing device, comprising:

obtaining a model comprising a parameterized objective function;

obtaining a first test setting comprising one or more first test hearing device parameters;

obtaining a second test setting based on the model, the second test setting comprising one or more second test hearing device parameters;

outputting a first test signal according to the first test setting;

outputting a second test signal according to the second test setting;

obtaining a user input indicative of a preference for the first test setting or the second test setting as a preferred test setting;

updating the model based on the preferred test setting; and updating the hearing device based on information associated with the preferred test setting;

wherein the model is updated based on a Bayesian or approximate Bayesian inference method.

21. A device comprising:

a microphone;

a processor coupled to the microphone, the processor configured to process input signals, and to provide an electrical output signal based on the input signals; and a receiver;

wherein the processor is configured to:

obtain a model comprising a parameterized objective function;

obtain a first test setting comprising one or more first test hearing device parameters;

obtain a second test setting based on the model, the second test setting comprising one or more second test hearing device parameters;

output a first test signal according to the first test setting via the receiver;

output a second test signal according to the second test setting via the receiver;

obtain a user input of a indicative of a preference for the first test setting or the second test setting as a preferred setting;

update the model based on the preferred test setting; and update the hearing device based on information associated with the preferred test setting.

* * * * *